United States Patent [19]

Cameron

[11] Patent Number: 4,885,856

[45] Date of Patent: Dec. 12, 1989

[54] OPTICAL PRISM DISPLAY DEVICE

[75] Inventor: Robert K. Cameron, Chicago, Ill.

[73] Assignee: Panel Graphics, U.S.A., Inc., Chicago, Ill.

[21] Appl. No.: 121,125

[22] Filed: Nov. 16, 1987

[51] Int. Cl.[4] ..... G09F 19/14

[52] U.S. Cl. ..... 40/453; 350/286

[58] Field of Search ..... 40/453, 454, 584; 350/286, 287

[56] References Cited

U.S. PATENT DOCUMENTS

| | | | |
|---|---|---|---|
| 1,933,763 | 11/1933 | Russell | 40/453 |
| 2,539,654 | 1/1951 | Barnes | 40/453 |
| 3,364,603 | 1/1968 | Tate, Jr. | 40/584 |
| 4,268,985 | 5/1981 | Lecznar | 40/584 |
| 4,277,139 | 7/1981 | Cox | 350/286 |
| 4,623,225 | 11/1986 | Forkner | 350/286 |

OTHER PUBLICATIONS

Rohm and Haas Company Reprint from "DESIGN" entitled Parts That Glow, A. M. Blumenfeld and S. E. Jones, pp. 2–11, copywright 1959.

*Primary Examiner*—Gene Mancene
*Assistant Examiner*—Michael Lynch
*Attorney, Agent, or Firm*—Wood, Dalton, Phillips Mason & Rowe

[57] ABSTRACT

A novelty or advertising display device is disclosed which has a base optical prism with polished surfaces on clear acrylic material with a top surface spaced above a bottom surface and a slanted viewing front face between them together with messages printed on the prism top and bottom surfaces or alternatively on a substrate sheet captured at the bottom surface with the messages so located in either instance, that some messages appear directly and in appearing and disappearing mirror image and other messages appear and disappear from view to a person moving relative to the device resting upon a table or countertop so as to draw attention to the display.

8 Claims, 2 Drawing Sheets

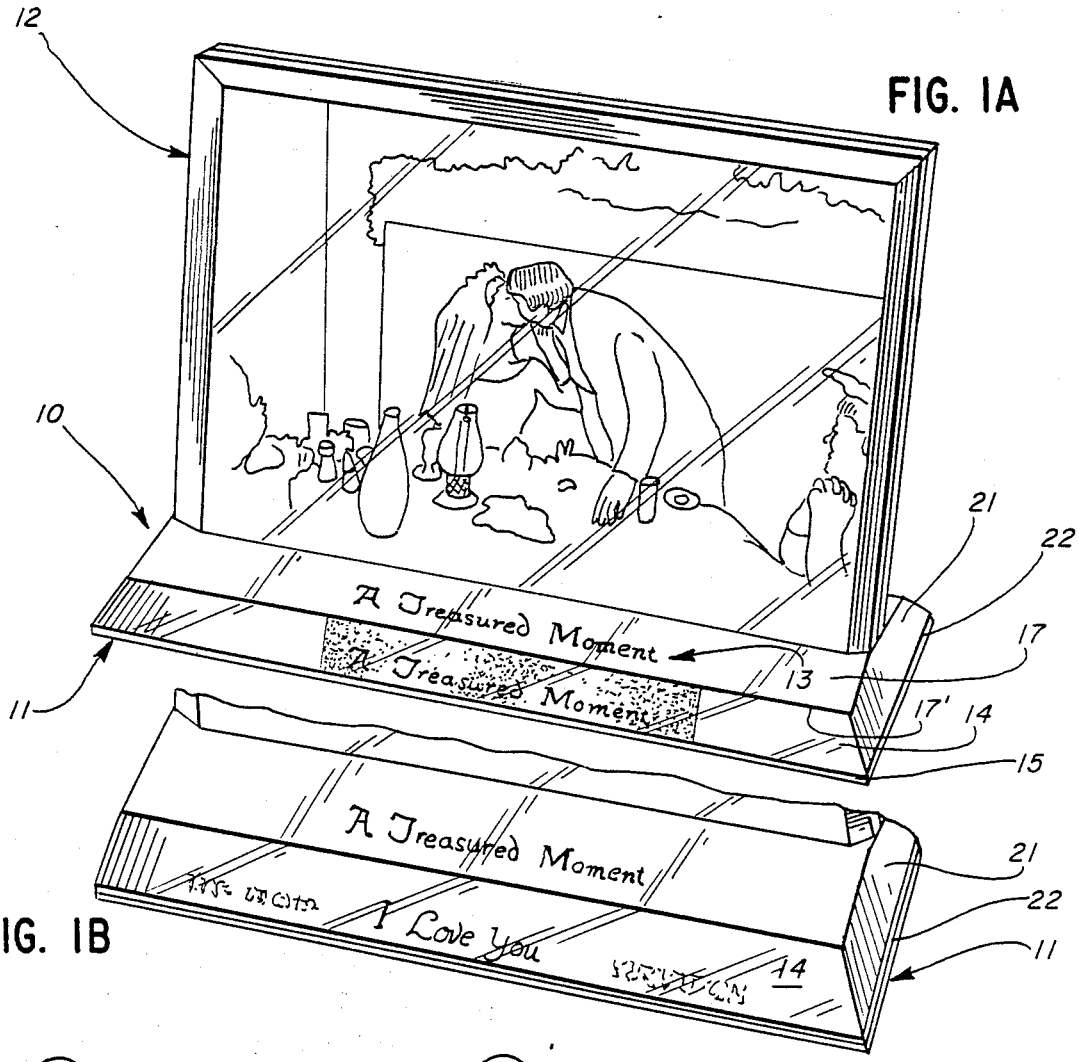
FIG. 1A
FIG. 1B
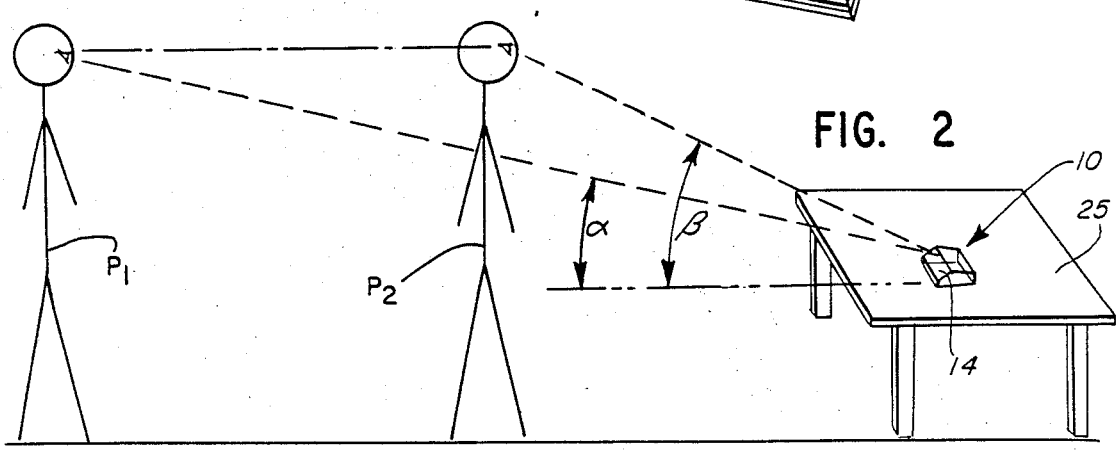
FIG. 2
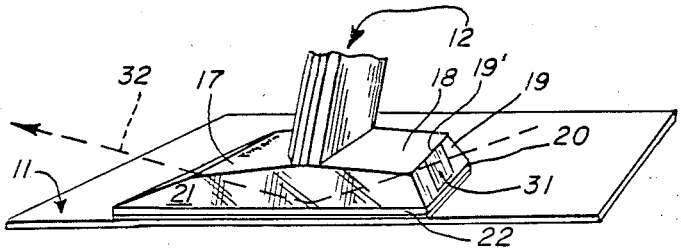
FIG. 3

FIG. 4
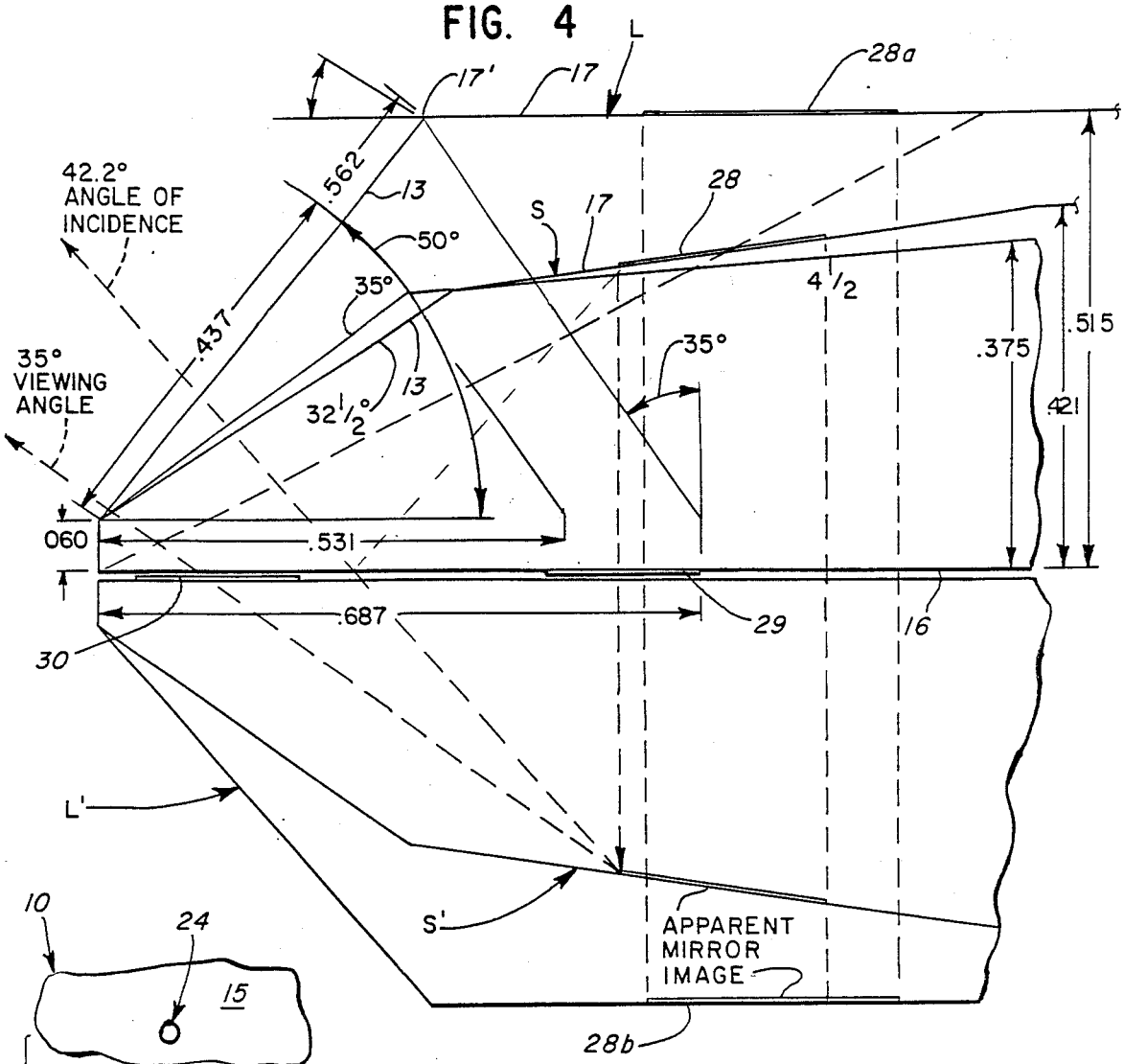
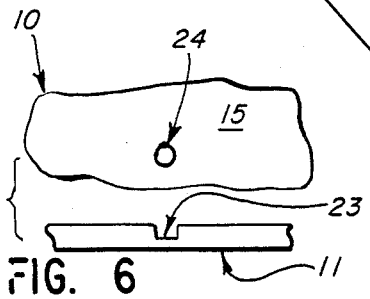
FIG. 6
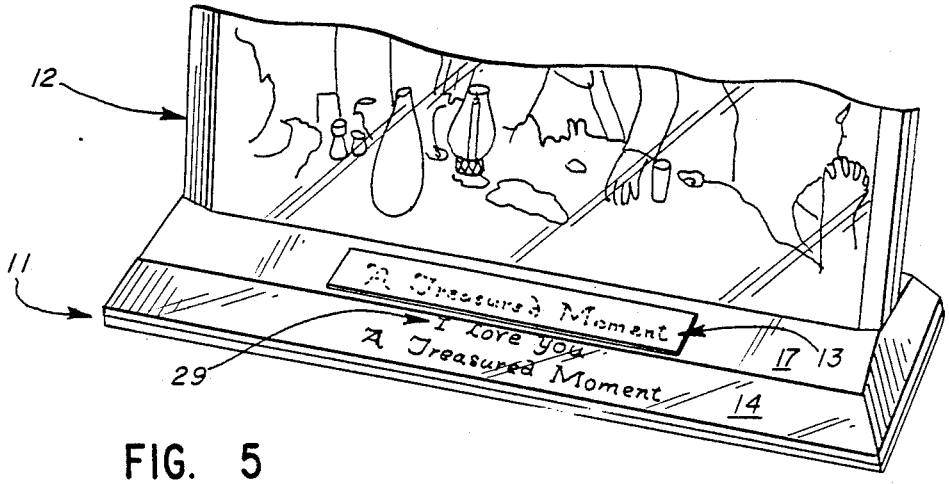
FIG. 5

OPTICAL PRISM DISPLAY DEVICE

FIELD OF THE INVENTION

This invention has to do with point of sale advertising display devices, novelty devices or decorative accessories which are used by a business to call attention to its goods or services and is generally expected to be a device for sitting upon a counter, tabletop, desktop or the like.

BACKGROUND OF THE INVENTION

Novelty devices or advertising displays are generally printed, colored and provided with eyecatching appeal, hopefully as the device is perceived by those creating such devices. Sometimes, in enhancement of the ability to call attention to the advertising or display device, some energy, battery power or electricity has been utilized to provide either movement or light, artificially applied to the device. Thus, movement or light has been used to attract attention to the message or intelligence wished to be transmitted to the passing public.

It is desirable in a display device to be able to inexpensively and without the use of complicated mechanisms or electrical connections of battery or power source, to create a display which will gather attention from a person moving toward or away from or relative to the display. While surrounding light may be reflected and refracted by an optical prism as is known, utilization of this phenomenon has in the past not been fully implemented to create a display which would call attention to itself by the changing visual effect that such a display may create.

The present invention is concerned with providing an optical display of unique character which by its construction may have messages or parts that seem to appear and disappear as a person moving relative to the display changes his position relative thereto. The phenomenon of appearance and disappearance of messages or indicia thus calls attention to the display giving it an ability to have message conveying appeal not heretofore available from stationary immobile displays carrying advertising material. A unique feature of the present invention is provision of a prism and message combination so related that a message important to an advertiser may remain in view while a second message may appear and disappear, thus calling attention to both messages.

SUMMARY OF THE INVENTION

This invention is concerned with a display of the type utilized on desktops and countertops of stores and various other public establishments in order to display material which the public is expected to see and is so constructed as to call attention to the display either for purposes of examining material held by the display or for calling attention to the desired giving of a brochure, pamphlet or something of like nature.

The display has, as an integral part, a base comprising an optical prism imprinted with messages which the public is expected to see. Without moving parts or energy utilization, the prism has messages which call attention to the display to a person moving relative to the display in that the messages appear and disappear depending upon the angle of view between the person viewing the display and the display itself.

The base prism of the present display may contain thereabove any number of different types of holders or appurtenances, which are for specific purposes. For example, the base optical prism may simply hold a frame in which a picture is to be displayed whereby the entire display is a novelty item for displaying important pictures, such as wedding, anniversary, birthday or pictures of other memorable occasions. On the other hand, the display may be a point of sale advertising type of display in which a box or holder for credit cards or brochures or other advertising material may be above the prism and the language utilized with or on the prism which appears and disappears as a person moves relative to the display will call attention thereto so that the person may receive or take that which the display is holding for his attention.

The display also has utilization as simply a desktop appurtenance in which case calendars, clocks, pencil holders, pen holders and other items may be appended to the base and the base equipped with messages appropriate to the advertising of the company employing the display to place its name before the people upon whose desk the display may sit.

It is a general object of the present invention to produce a novel and appealing optical prism display device.

A further object of the invention is to provide a display device in the nature of an advertising display in which an optical prism is employed with printing on paper held against prism planes or directly thereon in specific locations relative to the surfaces of the prism, such that messages may appear and disappear as a person moves relative to the display sitting upon a table top, countertop or the like.

A further object of the invention is to provide such an optical prism display device in which a base plate is mounted to the underside of the prism in such a fashion that it may be extended to support various other appurtenances commensurate with the use of the display intended by the owner thereof, or be of such size as to receive a clock, calendar or the like.

A further object is to provide an optical prism display device with faces thereon so oriented as to display messages which may, through refraction and reflection, appear and disappear to a person moving relative to the device. Such a prism is conveniently made of a clear acrylic molded material. In addition to the prism, the invention contemplates the utilization of a base member attachable to the base of the prism in such a manner as to permit the manufacturer of one prism form with various different base members to accommodate the various appurtenances that may be utilized with the prism.

Another object of the invention is to provide an optical prism through which message means may be viewed, which means is wholly carried on a substrate underlying the prism.

DESCRIPTION OF THE DRAWINGS

The invention is illustrated in its preferred forms in the drawings attached hereto in which FIG. 1A is a perspective view of a optical prism display device having a simple photograph receptacle appurtenance extending above the base prism;

FIG. 1B is a fragmentary view of the prism of FIG. 1A as it appears at a different viewing angle to a person;

FIG. 2 is a diagrammatic view of a base prism sitting upon a table with a person's different viewing angles illustrated for purposes of demonstrating the condition of the messages on the prism;

FIG. 3 is a fragmentary view of the base prism and picture holder with an alternate base member extended beyond the periphery of the prism;

FIG. 4 is an enlarged diagrammatic dimensioned illustration of the base prism and its messages and their appearance due to reflection and refraction;

FIG. 5 is a view similar to FIGS. 1A and 1B illustrating the condition of the messages at a different angle of view than those illustrated in FIGS. 1A and 1B; and FIG. 6 is a fragmentary view of one means for attaching the base plate to the under surface of the prism.

DESCRIPTION OF THE PREFERRED EMBODIMENT

Referring in general to FIGS. 1, 2 and 3, there is illustrated a base optical prism 10 sitting upon and extending above a base plate 11 attached to the underside of the prism and supporting in an upwardly direction thereover, a picture receiving frame 12 as illustrative of an appurtenance to be utilized with the base prism and base plate. In the particular illustration of FIG. 1A, the picture, such as a nuptial occurrence of two people, is a treasured moment reflected by the words "A treasured moment" 13 printed upon the base prism. It is to be understood that various appurtenances can be attached to the base prism and that illustrated is by way of example.

The base prism itself is preferably of a molded clear acrylic material. The molding employed is an injection process into a mold so prepared that each of the faces of the prism exit the mold in a highly polished condition. Basically, the prism can be made with a number of faces all generally flat and intersecting each other along lines that are parallel. Thus, for example, the prism has a front viewing face or plane surface 14 which is the principal plane through which the viewing of the messages to be printed upon the base prism is done. This face generally does not meet the bottom surface of the prism in a straight line as such an edge would be subject to damage in handling and thus the plate or face 14 meets a very short plane 15 which is generally upright relative to the bottom surface 16 of the prism (FIG. 6). The plane or face 14 need not have a large dimension in its upright direction and thus may be 0.060 of an inch or approximately ⅛ of an inch in height and will extend the entire length left to right of the prism as shown in FIGS. 1A and 1B.

Additional faces are formed on the prism as desired. Thus, a generally horizontal face 17 joins the window face 14 along a straight line 17′ which extends from left to right of the prism. The plane 17 may be parallel to the bottom 16 of the prism but preferably may have an upward slant relative thereto to a few degrees, about 3° to 7° being quite satisfactory.

The prism may also have an upper face 18 behind the picture frame which joins the face 17 along a line and at the intersection of those planes the appurtenance 12 may be secured to the prism by adequate adhesives. Generally, the face 18 may slant downwardly and rearwardly from the appurtenance 12 to intersect a rear face 19 along a line 19′ which is parallel to the line 17′ of intersection between planes 13 and 17. Here again, while the rear face 19 slants downwardly and rearwardly on the prism, it is generally desirable to have it terminate at a small face 20 which is upright relative to the bottom 16 on the prism in order to avoid any sharp corner at the rear of the prism which would be subject to damage in handling. The prism may have the seven faces described including the bottom face of the prism and this number may be varied as desired, particularly in the area of the rear of the prism. For example, the rear faces 19 and 20 could be combined into one upright face generally perpendicular to the bottom plane 16 of the prism.

The opposite ends of the prism may be variously formed and may include a slanted face, such as 21 shown in FIG. 1A, which also joins an upright base face 22, which intersects the bottom 16 of the prism and the opposite end of the base prism may be similarly formed. Generally, the downwardly tapered and flat face 21 on the ends of the prism gives the entire prism an appearance which is pleasing and may be chosen for that purpose, since, in the main operation of the optical display, the end surfaces have little importance.

The prism sits upon a base part, generally indicated 11, which may be a planar clear or opaque plastic molded plate. This plate may be of the same size as the base 16 of the prism, or it may be extended at one or more borders of the prism so as to provide a platform upon which appurtenances of various kinds may be mounted. For example as shown in FIG. 3, the base 11 has parts extending beyond the prism at the rear at the far side and at the front and upon these extended parts of the base plate, various holders for pencils, clocks, calendars or boxes in which brochures can be mounted, may be placed as desired. An important feature of the present optical display device is that the prism may be of a uniform size and various base plates applied to the bottom of the prism in order to vary the end use of the display. Thus, in FIG. 6, there is shown a base member 11 and one of four cylindrical wells 23 which are about 1/16 of an inch deep and by ⅛ inch round diameter for receiving with a press fit molded bosses 24 extending out from the bottom of the prism, generally at the four corners thereof. Since the prism may be molded with the upstanding cylindrical bosses in the four corners and the base plate may be made with holes to receive them, various sizes of base plates may be press fitted simply by finger pressure to assemble the base plate to the prism no matter what the size of the base plate may be relative to the prism. Since the cylinders are both molded into the clear acrylic of the prism, they are practically impossible of being viewed when the assembly is made.

Another important feature of the present optical display device is the ability to capture a substrate, such as paper, against the bottom plane of the prism for carrying various messages or the like. When messages printed on a substrate are positioned near the front slanted surface, such messages may appear or disappear depending upon whether a person's line of vision to the front surface is such that the message is viewable by the person being close enough that light rays exiting the front plane reach the person's eyes.

The use of the optical prism may vary as printings are either made upon surfaces of the prism or upon a paper material which is held against the bottom plane of the prism, and some variation in the appearance and disappearance of messages and the like will occur depending upon where the printing is placed.

In FIGS. 1A and 1B, a variation of the printing is shown as an example of the potential of using the optical prism for advertising at point of sale places or as a novelty item. Thus, for an example, in FIG. 1A, the message "A Treasured Moment" is shown as pad printed upon the upper plane 17 of the prism just rearwardly of the front viewing plane 14. Below the message 13 appears a mirror image of that message which will appear to a person whenever his viewing angle to vertical is within the 42.2° angle of incidence, taking into account such refraction as occurs at the front plane. Whenever his viewing angle is outside the angle of incidence, the mirror image disappears, he cannot see it and therefore the appearance and disappearance of the mirror image calls attention to the display.

Following the example of FIG. 1A, a different condition is shown in FIG. 1B. The phrase "I Love You" is printed upon a substrate, be it paper or the top of the underlying base plate, and thus this message will appear or disappear from the view of the person, such as illustrated in FIG. 2, the message being visible to a person at the position P2, but not visible when the person is at the position P1. On either side of the message "I Love You" are some hieroglyphics indicating the location of additional emblems, phrases, color splotches or the like, which may be used as printed either on the bottom of the prism or upon the top of a substrate. If they are on the bottom of the prism, they will generally be visible whenever the person approaches the display from either positions P1 or P2. If the additional material on either side of the message "I Love You" is on a substrate, then it will appear and disappear with the message "I Love You".

Referring to FIG. 4 specifically, three separate prism sizes with specific dimensions in inches for the location of messages, the sizes of the prisms and the shape and size of the angles between prism faces as well as a mirror image of the prism are illustrated for purposes of explanation only. Nothing is to scale, and the illustration is for discussion of what occurs when the messages are printed in various places upon the prisms. The smallest of the prisms is marked "S" and the largest marked "L", and all sizes of prisms in between them, have been found to give the phenomenon desired. The message in the position 28 or 28A is like that shown on the top surface 17 of the prism in FIG. 1A. Its apparent reflection mirror image marked **28*b*** is shown in the position that it appears to be to a person viewing the display, the vertical dashed lines being only for the purpose of illustrating the projection of the message below the actual printing upon the prism. The 42.2° angle of incidence to vertical is governed by the material of the prism, in this case a clear acrylic plastic material. The reflection light rays from the message appear to exit at any angle greater than the angle of incidence and at the front surface there can be some refraction of those light rays which is not illustrated.

A second message indicated 30 under the front slanting viewing plane 14 should be within approximately ½ inch of the front of the prism and placed upon a substrate below the actual prism if it is intended to be viewed at some times and disappear from view at other times. If the message 30 is applied to the bottom of the prism, even in the position shown, it will be generally viewable any time one can see the main message 28 printed upon the top of the prism.

Another message 29 is shown as applied to the bottom of the surface 16 of the prism at a position generally below the message 28 although not in exact vertical or upright projection. A message printed upon the bottom of the of the prism at this position will generally be viewable at any time that the message 28 is viewable on the top of the prism, in other words whenever a person is sufficiently close to the display to read any of the messages. Should the message 29, however, be placed upon the substrate, it may disappear from view whenever the message 30 disappears from view, although not precisely at the same moment.

A slightly different condition of the messages is illustrated in FIG. 5 for the purposes of illustrating the variation that may be achieved. In FIG. 5, the message 13 "A Treasured Moment" is printed upon the top of the prism, in other words, directly upon a mylar adhesive tape 13 applied directly to the upper surface 17 in such a manner that the message may be viewed even though it is on a tape which is primarily transparent. Below the tape there is shown a repeat of the message "A Treasured Moment" which is the mirror image of the message upon the tape. Appearing suspended in between is the message "I Love You" which is printed upon the bottom of the prism substantially in the position of the message numbered 30 in FIG. 4. The condition illustrated in FIG. 5 is that there is a direct viewed message and its mirror image with another message appearing to be suspended between the two. As a person moves from the position P2 back toward the position P1 shown in FIG. 2, the mirror image may disappear, leaving only the direct viewed message on the mylar tape printed on the top of the prism and the message which is printed on the direct lower plane of the prism. This also calls attention to the person who is viewing the display since there is a message that disappears from his view.

It has been found that the angle of the front viewing face to the horizontal or the plane 16 which is usually mounted upon a horizontal tabletop or the like, is preferably in or around 35° and preferably no less than 30° nor more than 40° to the horizontal. The variations in the angles and the shape of the planes forming the outer surfaces of the optical prism gives considerable leeway in the manufacture of the prism for the particular purposes desired. The angle of the upper face 17 to the lower plane 16 generally should be no more than 10° out of parallelism, and the appurtenances may be mounted generally somewhat rearwardly of the front angled face 14. A picture frame or other upright members which are slightly slanted to the rear from the attachment to the upper edge thereabove, may be mounted upon the prism itself or upon a base 11 rearwardly of the prism so as to leave a slot between the prism and attachment for holding cards and the like.

An important alternative to printing messages directly upon the optical prism is available with the present display structure. One optical clear plastic prism may be made with corner posts for attachment to a base without use of tools. A paper sized to be captured between the prism and its base, may carry all indicia, color, message, symbols and the like to be viewed. A primary message means may be printed in the position of message 28 (FIG. 4), that is directly below message 28. When a person moves to a proper location relative to the display, this primary message will appear as if printed upon the top surface of the prism. If message 28 is placed sufficiently back of the front plane 14, such message will be in constant view.

A secondary message means may be carried on such a paper in the position of the message 30 (FIG. 4). This secondary message will appear and disappear depending upon a person's viewing angle relative to the front plane of the display.

One advantage to the manufacturer of the displays of the foregoing alternative, is that prisms may be duplicated and then customized to a customer's needs or desires by the choice of the printed matter on the underlying sheet. Many varied messages may be provided by selection of an appropriately printed sheet to be assembled with a prism and its base.

As illustrated in FIG. 3, the back plane 19 of the prism may contain a message, a symbol or a colorful printing 31 which may occupy a designated space on the back plane and may be viewed through the front face along the sight line 32 dotted therein. Ordinarily, the back face is not utilized for printing as much as the faces 16 and 17.

The bottom plate 11, when fastened to the prism by the use of such removable means as the cylindrical protuberances 23 receivable in the molded-in holes 24 in the base plate, may have the printing, such as #30 in FIG. 4, applied to the base plate or to a paper which is caught between the prism and the base plate. Such a paper insert interposed between the upper surface of the bottom plate and the bottom surface of the prism gives no interference with the mirror image of the material 13 printed on the upper surface 17 of the optical prism. If the paper insert is used, the message will appear and disappear as the angle of view changes relative to the display. Such a use of a printed paper insert permits changes and ready adaptation of the optical prism to the particular use intended for the display.

An important use of the display is to provide a seeming animation of the display without the use of power or other means of producing motion. The mere appearance and disappearance of the messages allow an apparent animation of the display merely because of the reflection of light and the changing position between the person walking by the display in his angle of viewing the same. It is intended that the display may be a novelty device, which serves as an advertisement for companies' wishing to call attention to their company, their products or their services. It may be utilized to display cards or brochures which the passerby is hoped to receive by taking a sample held above the optical prism in a suitable holder for a supply of such. The prism may also form the base of a holder appearing on restaurant tables, perhaps advertising menu features or products offered to the patrons. It should be understood that the use of the phrases "A Treasured Moment" and "I Love You" as merely illustrative of a wedding scene and phrases appropriate to other photographic treasures and memories would be printed upon the faces where applicable.

There are many companies who have slogans and the optical prism may serve as a advertising device at point of sale for such companies whose name may be placed in the position of "A Treasured Moment" and who slogans might be in the position of the phrase "I Love You" in order that it may appear and disappear giving attention to the passerby to the display. Of course, in view of the manner in which prisms operate, any message which is printed at the position 31 on the back face 19 of the optical prism must be printed upside down in order to be viewed along the line 32 as upright when seen by a person in front of the display. The extension of the bottom plate 11 beyond the edges of the prism, as shown in FIG. 3, may provide a platform for the receptacle of any appurtenance desired and the extension may be on one or more sides or ends of the optical prism without altering the prism or the appearance and disappearance of the phrases printed thereon or on the topside of the bottom plate.

I claim:

1. An optical prism display device for novelty, artistic or functional use carrying visual effects or messages which may appear and disappear to a person moving relative to the display, comprising:

an optical prism having an optical system consisting of a plurality of plane surfaces including top, bottom, back and front surfaces, said prism being of transparent material, said surfaces being at an angle to each other, and including said front plane surface joining said upper and said bottom plane surface at an angle of 30° to 40° relative to the bottom surface, said bottom plane surface being horizontal and joining the front and rear plane surfaces along lines of intersection which are substantially parallel, a sheet of material underlying and appended to said optical prism and having an air interface between the bottom plane surface and the underlying sheet of material, a first message carried on the prism top plane surface in a position adjacent to the front plane surface so that said message may be directly viewed and a mirror image reflection thereof on said bottom plane surface may be viewed through the front plane surface, said mirror image reflection appearing and disappearing to view to a person moving relative to the prism as the angle of viewing changes relative to the critical angle of incidence of 42.2° of the bottom plane surface, a second message carried on the bottom plane surface positioned below and forward relative to the first message, said second message having alternatively appearing locations, one location appearing to be suspended between the first message direct-viewing location on the top plane surface and its mirror image reflection on the bottom plane surface and another location appearing to be on the bottom plane surface when the first message mirror image reflection disappears to view to a person moving relative to the prism as the angle of viewing changes, a third message or visual effect carried on said appended sheet in a forward position underlying said front plane surface so that same will appear to view through the front plane surface and on the bottom plane surface to a person moving relative to the prism as the angle of viewing changes relative to the prism, said third message being located to appear at the same time that said first message mirror image reflection disappears and when said second message no longer appears to be in a suspended location but appears as combined with said third message on the bottom plane surface, and a fourth message or visual effect carried on the rear plane surface generally upright joining the prism top and bottom plane surfaces so that said fourth message or visual effect may be viewed as a mirror image reflection thereof on the bottom plane surface through the front plane surface.

2. An optical prism display set forth in claim 1 including a bottom plate affixed removably to the bottom surface of the prism, said bottom plate having portions extending laterally of one or more edges of said prism for supporting appurtenances accompanying the prism to form the display device.

3. A novelty acrylic display carrying visual effects or messages which may appear and disappear to a person moving relative to the display, comprising:

a block of acrylic material having upper and lower planar polished surfaces spaced apart by the thickness of the block, a planar front polished surface on the block joining said upper and lower surfaces, and slanted rearwardly from said lower surface toward said upper surface, a sheet of material underlying and appended to said block and having an air interface between the polished bottom surface of the block and said underlying sheet of material, a first message carried on the block upper surface in a position adjacent said slanted front surface so that said message may be directly viewed and a mirror image reflection thereof on said lower block surface may be viewed through said slanted front surface, said mirror image reflection appearing and disappearing from view to a person moving relative to the display as the angle of viewing change relative to the critical angle of incidence of the acrylic plane polished bottom surface, a second message carried on said block lower surface positioned below and relative to the first message to be viewed through said slanted front surface, said second message when in view appearing suspended between said first message as directly viewed and the mirror image reflection thereof, and which, with a change in viewing angle relative to the critical angle of incidence of the acrylic planar polished bottom surface, will no longer appear to be suspended at the time the first message mirror image reflection disappears, a third message carried on said appended sheet in a position underlying the said block front slanted surface so that same will appear and disappear from view to a person moving relative to the display as the angle of viewing changes relative to the critical angle of incidence of the acrylic material bottom surface and at the same time that said first message mirror image reflection disappears and said third message appears as combined with said second message on said bottom polished surface.

4. A novelty acrylic display carrying visual effects or messages which may appear and disappear to a person moving relative to the display comprising:

a block of acrylic material having upper and lower planar polished surfaces spaced apart by the thickness of the block, a planar front polished surface on the block joining said upper and lower surfaces and slanted rearwardly from said lower surface toward said upper surface at about 32° to said lower surface when horizontal, a sheet of material underlying and appended to said block and having an air interface between the polished bottom surface of the block and said underlying sheet of material, a first message carried on the block upper surface in a position adjacent said slanted front surface so that said message may be directly viewed and a mirror image reflection thereof on said lower block surface may be viewed through said slanted front surface, said mirror image reflection appearing and disappearing from view to a person moving relative to the display as the angle of viewing changes relative to the critical angle of incidence of the acrylic planar polished bottom surface, a second message carried on said block lower surface positioned below and relative to the first message to be viewed through said slanted front surface, said second message having alternatively appearing locations, one location appearing to be suspended between the first message direct-viewing location and its mirror image reflection and another location appearing to be on said bottom polished surface, such apparent locations changing as the angle of viewing changes relative to the critical angle of incidence of the acrylic planar polished bottom surface, a third message carried on said appended sheet in a position underlying the said block front slanted surface so that same will appear and disappear from view to a person moving relative to the display as the angle of viewing changes relative to the critical angle of incidence of the acrylic block polished bottom surface.

5. A display as set forth in claim 4 wherein said block has a rear polished surface generally upright and joining said block lower and upper polished surfaces, a fourth message is carried on said rear surface and is viewable as a mirror image reflection off the bottom polished surface of the prism when viewed through the prism front surface.

6. A display as set forth in claim 4 in which the front polished surface is at an angle of about 35° to horizontal when the block lower surface is oriented horizontal.

7. A display as set forth in claim 4 in which the block lower surface and upper surface are oriented relative to each other from parallel to each other to diverging rearwardly from parallel up to about 10°.

8. A display as set forth in claim 7 in which block thickness measured perpendicular to the block lower surface is slightly less than a half inch, the slanted surface is at an included angle of about 35° to the lower surface and the first message is located within an inch of the front of the block.

* * * * *